US005199236A

United States Patent [19]

Allen

[11] Patent Number: 5,199,236

[45] Date of Patent: Apr. 6, 1993

[54] INSULATED GLASS/FLUSH OUTER SURFACE ARRANGEMENT

[75] Inventor: Glenn R. Allen, Burnaby, Canada

[73] Assignee: Aluglass Trading Company Limited, Canada

[21] Appl. No.: 693,336

[22] Filed: Apr. 29, 1991

[51] Int. Cl.[5] ..... E04C 2/46; E04B 1/60

[52] U.S. Cl. ..... 52/235; 52/397; 52/403

[58] Field of Search ..... 52/235, 397–403, 52/304, 305, 783, 476, 477, 656

[56] References Cited

U.S. PATENT DOCUMENTS

| | | | |
|---|---|---|---|
| 3,751,868 | 8/1973 | Mascioletti | 52/235 |
| 4,500,572 | 2/1985 | Francis | 52/304 |
| 4,543,755 | 10/1985 | Crandell | 52/235 |
| 4,552,790 | 11/1985 | Francis | 52/304 |
| 4,633,631 | 1/1987 | Crandell | 52/235 |
| 4,650,702 | 3/1987 | Whitmyer | 52/235 |
| 4,738,065 | 4/1988 | Crandell | 52/235 |
| 4,766,709 | 8/1988 | Galbraith | 52/235 |
| 4,809,475 | 3/1989 | Emmer | 52/235 |
| 4,843,773 | 7/1989 | Richter | 52/189 |
| 4,854,098 | 8/1989 | Emmer | 52/398 |
| 4,887,402 | 12/1989 | Da Col | 52/235 |
| 4,905,435 | 3/1990 | Horst | 52/235 |
| 4,912,898 | 4/1990 | Holmes | 52/398 |

OTHER PUBLICATIONS

WO 91/04389, 3 pages of the drawings, and 29 pages of the specification, dated Apr. 4, 1991.

Publication—"The Duratec Difference" and accompanying Duratec drawings dated Sep. 12, 1988.

*Primary Examiner*—James L. Ridgill, Jr.
*Attorney, Agent, or Firm*—Barrigar & Oyen

[57] ABSTRACT

A pre-fabricated window assembly for flush-appearance glazing comprises a conventional single-pane or dual-pane assembly. In the latter case, the spacer elements are inset from the peripheral edges of the window assembly. One of two types of extrusion is provided along each peripheral edge of the window assembly which provides a bonding surface to which the flush mounted lite is adhered by means of a bonding cement plug. The extrusion on one side of each pair of opposed sides of the window assembly is provided with a quick push-on or hook-on connector which mates with a complementary connector on the mullion or grid frame. The other extrusion on the opposite side of the window unit, for each pair of opposed sides, is similarly configured, except that the connector is a permanent connector for permanent securing of the extrusion to an appropriate mating fastener on the grid frame. Where a dual glazed window assembly is used, each of the extrusions is provided with a channel in which the peripheral edge of the inboard lite is mechanically gripped. The extrusions, in that event, are also provided with a rib or flange forming with the inner side of the inboard lite a recess into which a bonding agent may be placed to adhere the inner lite to the extrusion. The extrusions and the bonding cement are all applied in the factory to make the complete pre-fabricated window assembly.

21 Claims, 7 Drawing Sheets

INSULATED GLASS/FLUSH OUTER SURFACE ARRANGEMENT

FIELD OF THE INVENTION

This invention relates to a pre-fabricated window assembly for external flush-appearance mounting to the mullion or grid frame of a building.

BACKGROUND OF THE INVENTION

It has become fashionable to glaze office buildings with window assemblies comprising glass sheets arranged in a rectangular grid pattern and bordering fairly close to one another without any major surface interruption—i.e. without any retainer device overlapping adjacent panes that protrudes outward beyond the outer glass surface. Such flush mounting of windows presents to the external viewer the appearance of a continuous plane surface.

Where only one lite of glass is involved, the problem of retaining the glass in place is not too severe, since there is ample opportunity to adhere the single pane to the grid frame or mullion using a strong adhesive bond. When dual-pane insulated glass is involved, both the inboard lite and outboard lite must be adhesively bonded; conventionally, there is no mechanical retaining element present. Conventional arrangements often do not permit the outboard lite of glass to be as firmly anchored by the bonding cement or agent as would be wished, since there is limited bonding surface available and shear stresses are severe. A further difficulty is that with many conventional arrangements, the bonding cement has to be applied in the field where rain, dust, grease, etc., interfere with provision of clean glass and metal surfaces to which the bonding cement can adhere; furthermore, adverse tempe·ature conditions and inadequacies of field labour may contribute to less than an adequate bond.

Various solutions to this problem have been proposed by prior inventors.

These various prior solutions tend to be lacking in at least one of the following respects:

(a) The structure does not lend itself to pre-fabrication of the window assembly but requires application of bonding material in the field.

(b) The structure admits of limited bonding surface, especially for the outboard lite.

(c) The structure does not permit the use of the conventional insulated dual-pane assembly comprising an inboard and outboard lite separated by a peripheral spacer and having primary and secondary seals.

(d) The structure does not admit of quick and secure positioning thereof (at least along one edge) to the mullion.

(e) The structure applies or transmits stresses in the connection of one window panel to the adjoining window panel.

(f) The structure does not permit ready removal of individual panels for repair or replacement.

Of the prior solutions, some of those of Francis superficially somewhat resemble the structure of the present invention (see U.S. Pat. Nos. 4,500,572 and 4,552,790). Francis, however, does not provide in two opposed integral extrusions (respectively one for each of the two opposed sides of the window assembly) a gripping means for the inboard lite and a push-on attachment/positioning means for quick attachment of one side of the window assembly. Furthermore, Francis departs in a number of his solutions from the conventional dual-pane insulated window structure having a peripheral spacer and two seals and instead varies this structure, depending upon which of his various alternative solutions is adopted. Francis instead permanently fastens two adjacent window panels using a fastener common to both. This means that stresses applied to one window panel can be undesirably transmitted to the next adjoining panel via the common fastener. Further, one window unit cannot be removed without unfastening adjacent window units.

SUMMARY OF THE INVENTION

I have devised a window assembly in which the conventional dual-pane insulated window structure having a spacer and primary and secondary seals in the vicinity of the periphery of the dual-pane assemblies (which are conventionally rectangular in configuration) may be used, whilst providing a more secure bond for the outboard lite and a secure mechanical grip for the inboard lite, as well as a quick-fit (quick positioning push-on or hook-on) element for quick connection to the building frame as well as a more secure connection (e.g. threaded bolt) for the window assembly to the grid frame.

To accomplish this, I offset the spacer and associated primary and secondary seals of the conventional dual-pane assembly to form a slight peripheral gap or recess. I provide an extrusion of aluminium alloy or other suitable material having a pair of ribs or flanges forming a recess in which the inboard lite is inserted, for gripping the inboard lite (typically with a resilient pad interposed between the glass and the metal to protect the glass). This extrusion also provides a bonding surface extending generally parallel to the inner peripheral surface of the outboard lite and forming a recess therewith to receive bonding material for bonding the outboard lite to the bonding surface. The extrusion also provides a stepped inner surface parallel to and spaced from the inner surface of the inboard lite to form therewith a recess for the insertion of bonding material to bond the inboard lite to this inner surface of the extrusion. Finally, the extrusion includes a connection element for connection with a cooperating complementary element in the grid frame or mullion to which the window assembly is to be attached. Two separate types of connection are provided, one on each of two opposed extrusions. On one of the extrusions along one edge of the window assembly, this connection element is a quick-fit (quick positioning push-on or hook-on) element or the like that positions and retains one side of the window assembly in place through a quick-fit engagement of the push-on/hook-on element with a cooperating mating element fixed to the grid frame or mullion. The extrusion for the opposing side of the window assembly may also have a push-on/hook-on quick-fit connection capability similar or identical to that of the first of the two extrusions mentioned, but in any case has a more permanent securing capability (e.g. a series of holes to receive bolts for threading into mating threaded female sockets in the grid frame or mullion).

Typically, the vertical and horizontal mullions for a given building are arranged in a rectangular grid pattern for receiving a series of window assemblies such as the foregoing to form an eventual rectangular array of such window assemblies which, when installed, present an essentially planar outer surface comprising for the most part the outer surface of the outboard lites. A slight gap exists between adjacent lites which can be filled with a backing rod and/or bonding or adhesive plug such as low-modulus weather sealant (such arrangements being conventional in the flush mounting of glass panels to buildings). For most advantageous use of my invention, all four sides of the window assembly would be provided with extrusions of the sort that I have mentioned. On each pair of opposed sides, one extrusion would be provided with a quick-fit element, and the other would be provided with a more secure connection element. In that way, the window assemblies can be quickly positioned and connected to the building frame in sequence after one window assembly has been secured. The next adjacent one can be positioned in place first by positioning the quick-fit side of the window assembly and then, once the window is generally in position, securing the other side by the more permanent type of fastening provided.

Where the window assembly has to be connected by means of the quick connection to two of its sides meeting at a corner, first one side is engaged by the quick-fit push-on/hook-on connection along that side, but with the window assembly slightly linearly displaced away from the adjacent window assembly relative to the edge which has not yet been placed in push-on engagement therewith. Then the window assembly being installed is slid along the line of the quick-fit connection already made in the direction of the remaining quick-fit connection to be made, with the result that the latter connection is made, whereupon the remaining two sides of the window assembly can be fixed in place using more the more permanent window assembly connections. The whole process for a given window is quickly and easily done, in a matter of seconds for smaller pieces, and within a very few minutes for larger pieces.

Typically, the gap between the outer surface of the inboard lite and the inner surface of the outboard lite is wider than the gap that is desirable for filling with bonding material (i.e., the gap between the inner surface of the outboard lite and the bonding surface to which it is to be adhered. Consequently, the bonding surface provided for this purpose by the extrusion should be stepped outwardly from the outer surface of the inboard lite to reduce the width of the recess remaining between that bonding surface and the inner surface of the outboard lite; the recess so formed will have a width that is substantially less than the width of the gap between the outer surface of the inboard lite and the inner surface of the outboard lite of the assembly. This requirement is determined by conventional specifications for the use of conventional chemical bonding agents.

As a further aspect of my invention, I provide a single-pane window assembly having the lite-gripping, extrusion, quick-fit push-on/hook-on and securing characteristics of the dual-pane assembly just described, but omitting the second lite and associated bonding surface and mechanical elements. The provision of a single-pane assembly compatible with my dual-pane assembly permits the flush mounting of both vision and spandrel assemblies on the same supporting grid frame without any differentiation in structure of the grid frame.

DETAILED DESCRIPTION WITH REFERENCE TO THE DRAWINGS

Figure 1:
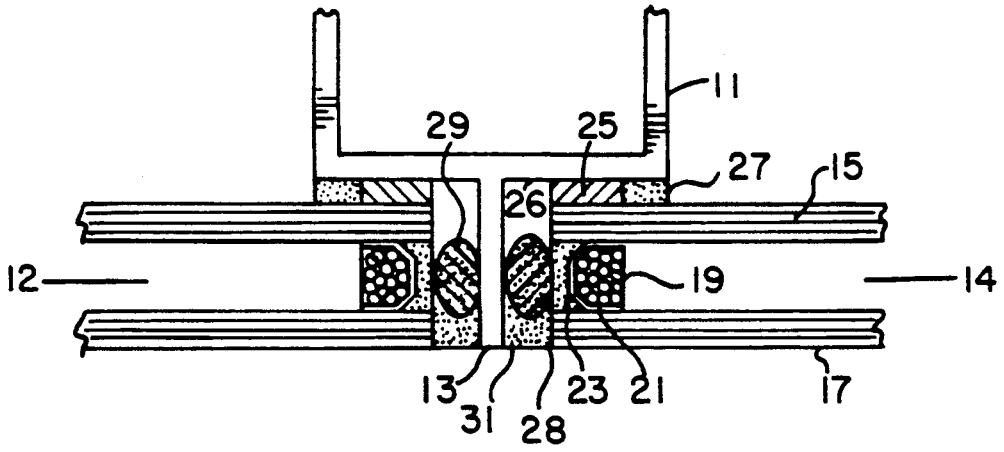
FIG. 1 (PRIOR ART)
FIG. 1 (prior art) is a horizontal section view through a conventional dual-pane insulated glass assembly as mounted in place on the mullion of a building frame.

A conventional double insulated flush glazed arrangement of the type known in the art appears in FIG. 1, viewing a vision mullion in section.

In FIG. 1, an upright generally rectangular grid framepost 11 is provided with an outwardly extending vertical rib 13 against which the sides of adjacent window assemblies 12, 14 indirectly bear. (Vertical rib 13 is not always present in conventional assemblies). In a dual-pane insulated glass configuration, each window assembly conventionally comprises an inboard lite 15 and an outboard lite 17 between which a spacer 19 (typically including an internal desiccant) is disposed. A primary seal 21 seals the interior airspace between lites 15 and 17 from the external atmosphere. The primary seal 21 may be, for example, a polyisobutylene compound resistant to vapour transmission. A secondary peripheral seal 23 extending over the entire peripheral span between lites 15 and 17 is applied between the two lites near the outer side edges thereof. This secondary seal 23 is typically made of silicone or polysulphide material or the like, and structurally connects together the lites 15 and 17.

When the window assemblies of FIG. 1 are installed, a spacer 25 is placed between the inner surface of lite 15 and an abutting surface 26 of the framepost 11 and then silicone bonding cement is applied in an elongated plug layer 27 which is intended to adhere firmly to the inner surface of lite 15 and to the framepost 11 so as to retain the lite 15 in place against framepost 11.

A backer rod 29 is placed under compression between the secondary seal 23 and the rib 13 and then the remaining outboard gap exterior to backer rod 29 and extending between the side edge 28 of outboard lite 17 and rib 13 is filled with a further silicone cement plug strip 31. This plug strip layer 31 is intended to adhere to the outboard lite 17 and help retain it in place, whilst at the same time providing a weatherproof seal between adjacent lites.

In practice, while the tension bond formed by inner silicone cement plug 27 is usually sufficient to retain the inboard lite 15 in place, the outer plug 31, on the other hand, is less successful in retaining outboard lite 17 in place because the adhering surface is limited and because shear and tension stresses are applied to the bond. Also, the surfaces are exposed to the weather and contaminants, which can interfere with successful bonding. The result can be that after a period of time, the lite 17 is no longer retained in place firmly and may become dislodged, with attendant risk of falling glass to persons and objects below.

The foregoing problem tends to be compounded by adverse weather conditions, contamination of glass surfaces and inadequate field labour practices.

The invention overcomes the foregoing problems by entirely eliminating the field application of the silicone cement for bonding the lites to the mullion, and instead provides a pre-fabricated window assembly in which the bonding of the lites is entirely effected in the factory, and further provides an additional mechanical structure, viz. an aluminum or similar extrusion at the edge of the lites, for gripping and retaining the inboard lite and for bonding to the outboard lite. This facilitates bonding, retention and installation. Further, such extrusion provides good bonding surfaces parallel to the planes of the lites to retain both the inboard lite and the outboard lite in place, and makes the assembly easy to handle and quick to instal at the building site.

Figure 2:
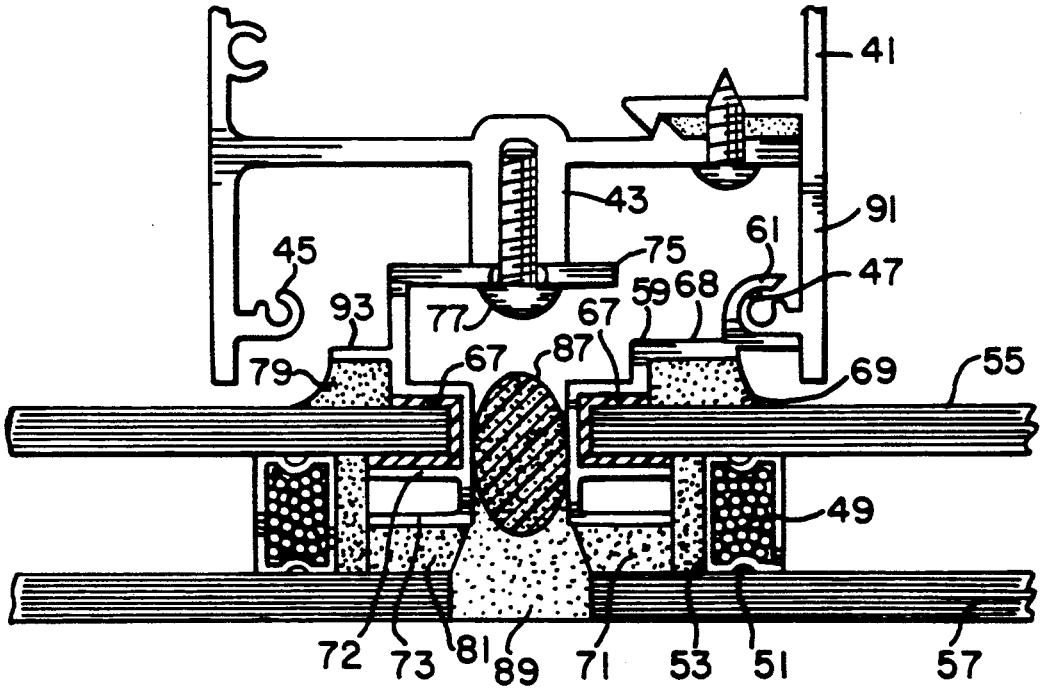
FIG. 2 is a section through a dual-pane window assembly constructed in accordance with the teaching of the present invention and the associated mullion of the building frame.

Referring to the representative inventive structure of FIG. 2, the inboard lite 55 and outboard lite 57, the spacer 49 with internal desiccant, the primary seal 51 and the secondary seal 53 are all essentially structured in the same way as the conventionally glazed insulated window structure illustrated in FIG. 1, with one exception, viz. that the positioning of the spacer 49 and the associated primary and secondary seals is slightly different—these elements are spaced slightly inset from the outside peripheral edges of the two lites 55 and 57, to accommodate the extrusion to be described.

A specially configured extrusion 59 of aluminium, or other suitable material, is applied to and grips the peripheral side edge of inboard lite 55. A rubber or other strong, soft pad 67 may be interposed between the glass surfaces and the metal surfaces to help prevent glass chipping or breakage and to assure a snug fit of the extrusion 59 over the side edge of the inboard lite 55. The extrusion 59 is stepped to form a shoulder 68 to provide a channel in which silicone cement plug 69 can be formed to adhere the inboard lite 55 firmly to the extrusion 59. The same shoulder portion 68 of the extrusion 59 is continued to form a generally U-shaped continuous extruded female receptacle or trough 61 for engagement with a mating protruding continuous extruded male lug 47 formed on an interior surface of a protruding rib 91 of grid framepost 41. This ready mating engagement constitutes the quick-fit capability of this embodiment of the invention.

At the other end of the extrusion 59, two ribs, or flanges, 63, 65 parallel to the planes of the lites are formed in the extrusion and spaced from one another and lie within the peripheral gap between the side edges of the lites. The inner flange 63 forms one side of the channel in which lite 55 is retained, whilst the outer flange 65 provides a first bonding surface between which and the inner adjacent surface of outboard lite 57, a silicone cement plug 71 is applied to ensure a firm tension adhesive bond between the flange 65 and the outboard lite 57, thereby assuring adequate retention of the outboard lite 57. The foregoing structure comprising the lites 55, 57, the spacer 49 and accompanying seals 51, 53, the extrusion 59 and the two silicone cement plugs 69 and 71 can all be manufactured indoors in the manufacturing plant under controlled conditions so that a firm bond is obtained on clean surfaces.

Extrusion 59 is formed on one side edge of the insulated window structure; on the other (opposite) side edge is formed a similar extrusion 73 configured identically (but in opposite sense) to extrusion 59 in so far as the relationship to the outboard lite 85 is concerned, but structured somewhat differently inwardly of the inboard lite 83. A rib 93 projecting inwardly parallel to lite 83 provides a second bonding surface and forms a channel within which silicone cement plug 79 is deposited, adhering the rib 93 to the lite 83. The remaining portion of extrusion 73 comprises an L-sectioned flange 75 through holes or slots in which vertically spaced series of bolts (schematically shown as 77) are positioned to engage a complementary series of mating threaded receptacles 43 integral with or affixed to framepost 41. For mounting convenience, receptacles 43 are preferably formed not as discrete receptacles but rather as a single extruded screw chase which throughout its length has internal serrations matingly engaging bolts 77.

Again, the extrusion 73, its associated pad 67, and silicone cement plugs 79, 81 are applied in the factory or shop rather than in the field.

When installation of the completed window assembly is made in the field, the factory-assembled double-insulated unit is swung into place with female extruded receptacle 61 engaging mating male lug 47. Then the other side of the window assembly having an extrusion 73, is fixed firmly into place by threading bolt 77 into threaded socket 43 of grid framepost 41. Conveniently, the mullion is designed symmetrically so that opposed continuously extruded lugs 45, 47 can receive window assemblies configured in either sense. Note that the foregoing attachment procedure is readily reversed, permitting removal of an individual window unit without unfastening adjacent window units.

What has been described applies to the configuration of the window assembly for attachment to the vertical mullion; it is obvious that the same arrangement can be utilized for the horizontal attachment as well as the vertical. To this end, a given window assembly is provided with extrusions 59, 73 on both pairs of opposed sides of the assembly, i.e. on opposed vertical sides and also on the top and bottom edges of the window assemblies, so that all four edges of the rectangular glass unit are provided with extrusions and associated structure according to the invention.

Installation is then effected by quick connecting first the top peripheral window assembly extrusion and then one side extrusion to the grid frame, following which the bottom extrusion and the other side extrusion are permanently fastened in place. The procedure is readily reversed for removal of the window unit. Note that since the window assembly is temporarily held in place only by the engagement of its top extrusion with the mating frame lug, it may be desirable to impart some slight curvature to the mating female/male quick-fit elements to form a slightly hooking engagement rather than merely a push-on engagement. However, too much "hooking" can interfere with quick initial positioning of the window assembly. A design balance must be struck.

Once the bolt 77 has fixed the window unit firmly in place, a backer rod 87 is inserted under compression between adjacent window assemblies and then finally a plug 89 of silicone cement is applied to seal the remaining recess between the side edges of adjacent outboard lites 57, 85. (This plug 89 of course must be removed and the backer rod 87 removed when it is desired to remove the window).

Figure 8:
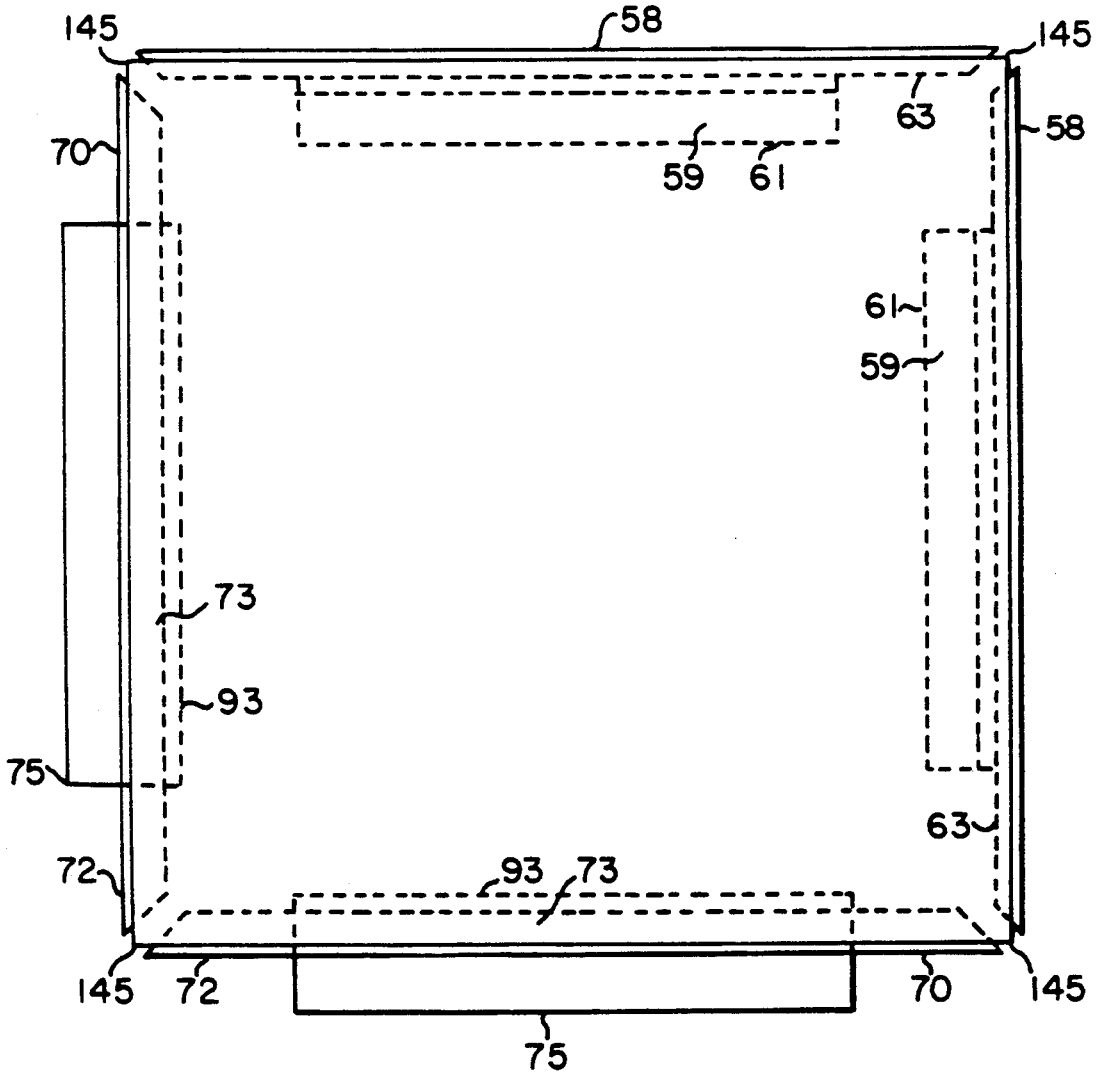
FIG. 8 is a schematic elevation view of a window assembly incorporating the structures of FIG. 2.

FIG. 8 is a schematic exterior elevation view (as it would be seen mounted on a building) of a window assembly incorporating the structure illustrated in FIG. 2. Along two adjacent sides 58, an extrusion 59 is disposed, and along the other two adjacent sides 70, opposed to the first two sides 58, an extrusion 73 is disposed. Those portions of extrusions 59, 73 that are on the interior side of the window assembly are shown in broken lines.

The inboard lite gripping portions 63, 72 of the extrusions 59, 73 respectively continue throughout most of the length of the peripheral edges of the window assembly, terminating just short of corners 145 of the assembly. This slight gap facilitates drainage of condensation, and affords venting for the window assembly. But the quick-fit extruded female portions 61 and permanent securing flanged portions 75 of the extrusions 59, 73 respectively stop short of corners 145 by a greater distance (conveniently about two inches) than lite-gripping portions 63, 72, which may reach to within about ¼ inch or less of the corners 145. The reason for this is to permit each window assembly to be readily moved up and down, left and right during the installation process so that the worker installing the assembly will have minimum difficulty in positioning it correctly. Note that during installation, female extruded quick-fit element 61 must be able to clear the projecting portions 91 of mullion 41, and that requirement determines the minimum length of the distance between the termination of the shorter portions of the extrusions 59, 73 and the corners 145 of the window assembly.

Note that because each window unit is individually attached to the grid frame, stresses that may occur in one unit are not automatically transmitted to adjacent units, especially if the fastener arrangements are provided with means (e.g. plastic washers capable of some slippage, or slots rather than circular holes through flange 75) accommodating some shifting of the building as it settles, or under wind load, etc.

Alternative configurations are possible within the scope of the invention.

Figure 3:
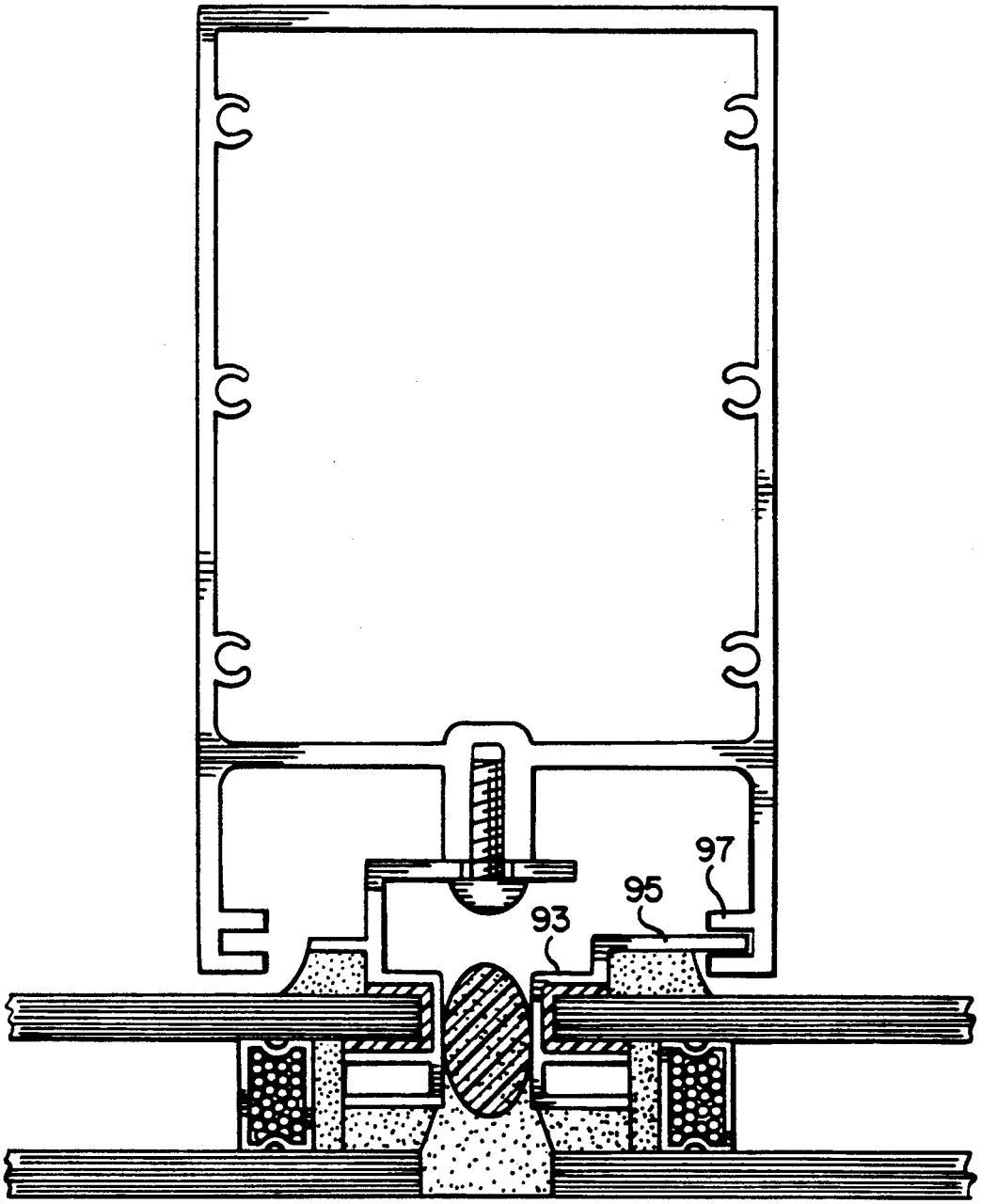
FIG. 3 illustrates in section an alternative extrusion arrangement with accompanying receptacle in the mullion which can be used in substitution for one of the extrusions illustrated in FIG. 2.

FIG. 3 illustrates an alternative extrusion cross-section configuration and mating portion of the frame post, to be substituted for elements 59 and 47 as shown in FIG. 2. Specifically, extrusion 93 is shaped similarly to extrusion 59 shown in FIG. 2, but instead of terminating in a jaw 61 at the upper end of the extrusion (as seen in the drawing) extrusion 93 terminates in a post 95 which engages a receptacle 97 in frame 41. This constitutes an alternative quick-fit capability.

Figure 4:
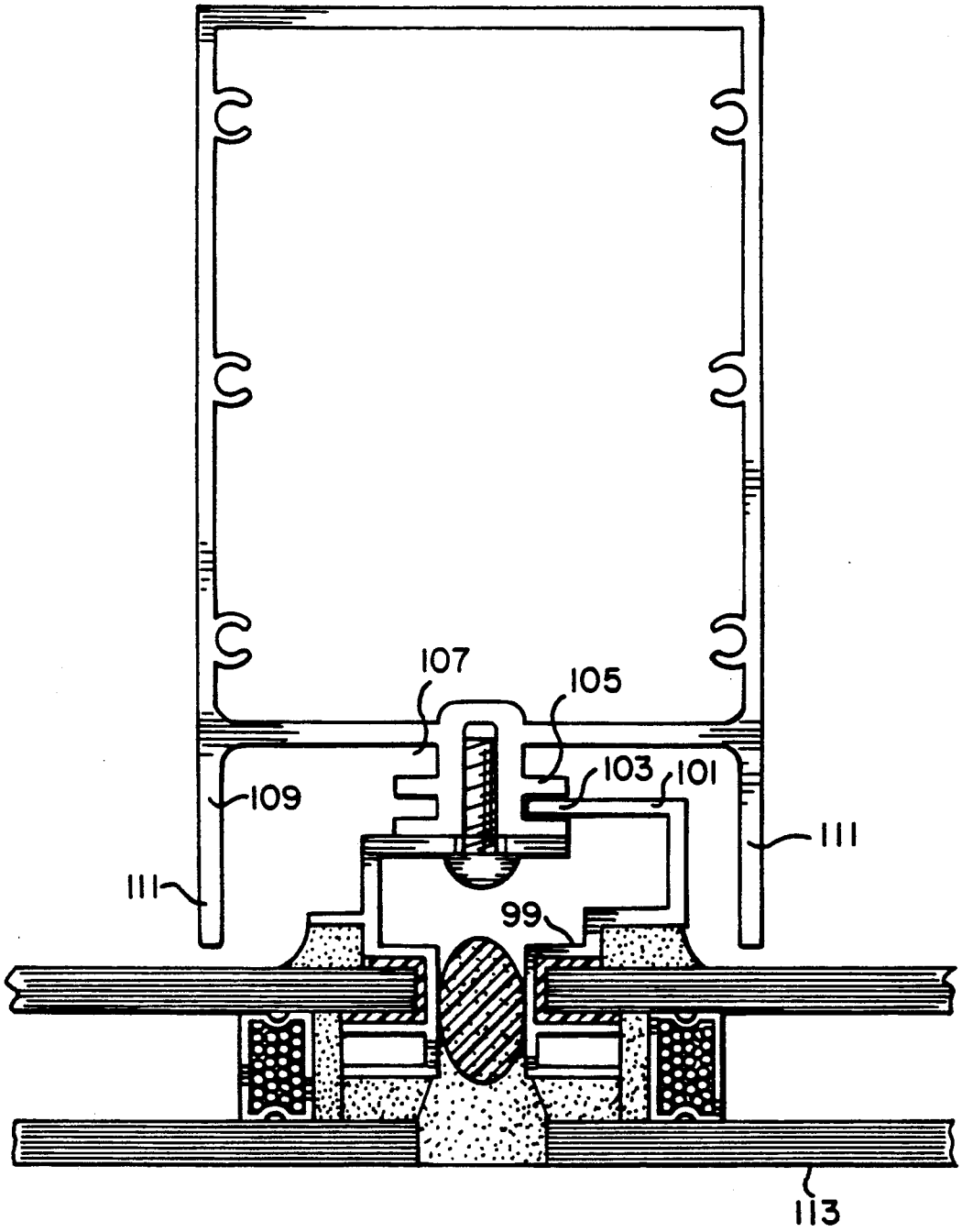
FIG. 4 illustrates in section an alternative extrusion and mating receptacle in the mullion that can be used in substitution for one of the two extrusions illustrated in FIG. 2.

FIG. 4 illustrates a further alternative extrusion design. At its bottom portion (as seen in the drawing), extrusion 99 is generally similar to extrusion 59 of FIG. 2. But its top portion is given a reverse turn to form a flange 101 whose protruding free end 103 matingly engages female receptacle 105 formed as an extruded trough or recess in screw chase extrusion 107 of the mullion 109. This structure is advantageous in eliminating the need for side receptacles or lugs on the sides 111 of mullion 109. And it may be easier to quick fit by pushing the right-hand window assembly 113 (as seen in the drawing) to the left rather than to the right. But it is disadvantageous in that receptacle 105 is further inward than is, say, lug 47 of FIG. 2. And all of the stresses imparted by the window assemblies to the mullion 109 are borne by the screw chase extrusion 107, instead of being borne by different portions of the mullion, as in FIG. 2.

Figure 5:
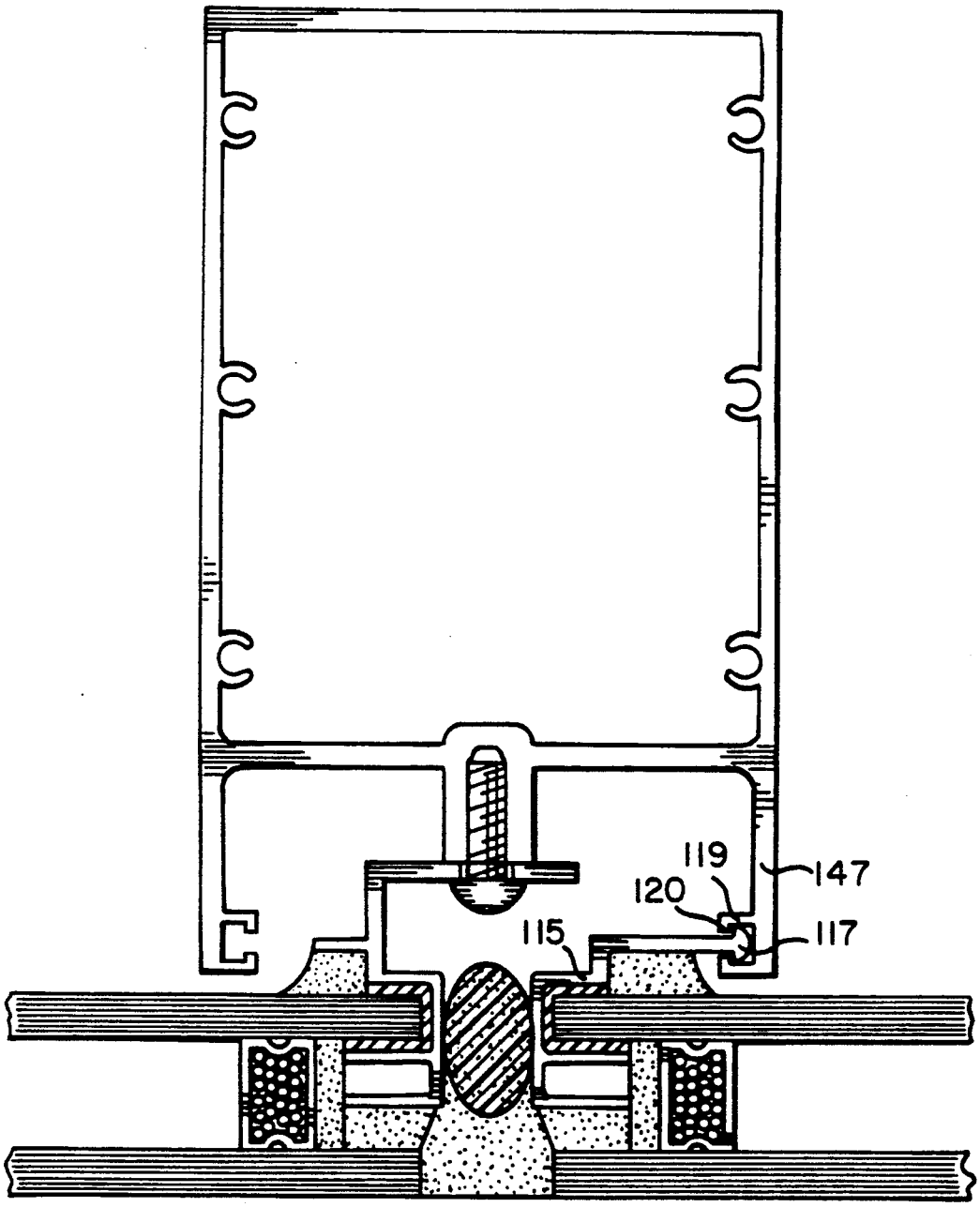
FIG. 5 illustrates in section a further alternative extrusion and mating receptacle in the mullion that can be used in substitution for that of FIG. 3.

FIG. 5 shows a further alternative extrusion structure to be substituted for extrusion 59 of FIG. 2. This extrusion, designated 115 in FIG. 5, is shaped like extrusion 59 at the lower most portion, but at the upper portion, terminates at the right hand upper extremity in a rounded head portion 117 which engages a snap receptacle 119 in the frame 147, thus affording yet a further quick-fit alternative structure. The snap fit of the head 117 into the receptacle 119 gives additional assurance that the extrusion 115 and associated window assembly portions will be securely held while the installer then lines up the other edges of the window in place and then eventually bolts the opposed extrusion to the frame. The flanged gripping portions 120 of receptacle 119 have been exaggerated in length in FIG. 5 for convenience of illustration and understanding.

Figure 6:
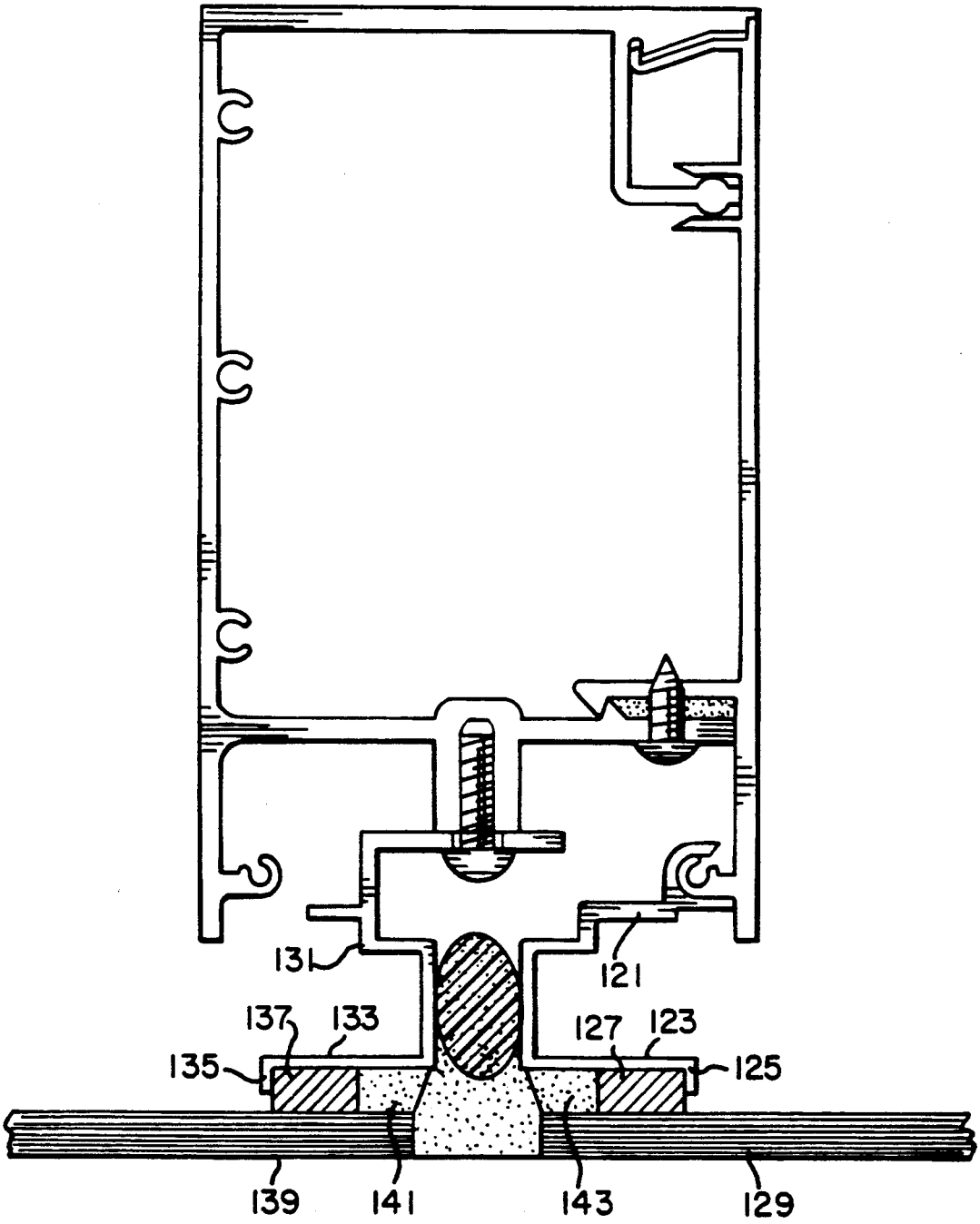
FIG. 6 is a horizontal section view through a single-pane window assembly according to the present invention and associated portions of the building frame mullion.

In some cases, a double-glazed window assembly is not required. Nevertheless, the means of attaching the window assemblies to the building frame as illustrated with reference to FIG. 2, can be used also for a single-glazed window assembly, as shown in FIG. 6. The elements in FIG. 6 are identical to those in FIG. 2, with the exception that the right hand extrusion 121 is configured at its lower portion (as seen in FIG. 6, which is a section view of a spandrel-mullion) without an intermediate rib 63 and with a somewhat extended lower rib 123 which terminates in a flange 125. The flange 125 is configured to fit about a spacer 127 adjacent to the single lite 129 of the window assembly. The counterpart left hand extrusion 131 is configured in the same manner in its upper portion as the extrusion 73 illustrated in FIG. 2, but its lower portion is configured to be the mirror image of the extrusion 121, i.e., there is no additional leftward protruding rib such as the rib 72 in FIG. 2, and the leftward protruding rib 133 is the mirror image of rib 123 of extrusion 121, and terminates in a flange 135 which is configured to conform with the adjacent spacer element 137 contacting the associated lite 139. Cement plugs 141 and 143 conform generally to plugs 81 and 71 shown in FIG. 2, respectively, and serve the same purposes.

Figure 7:
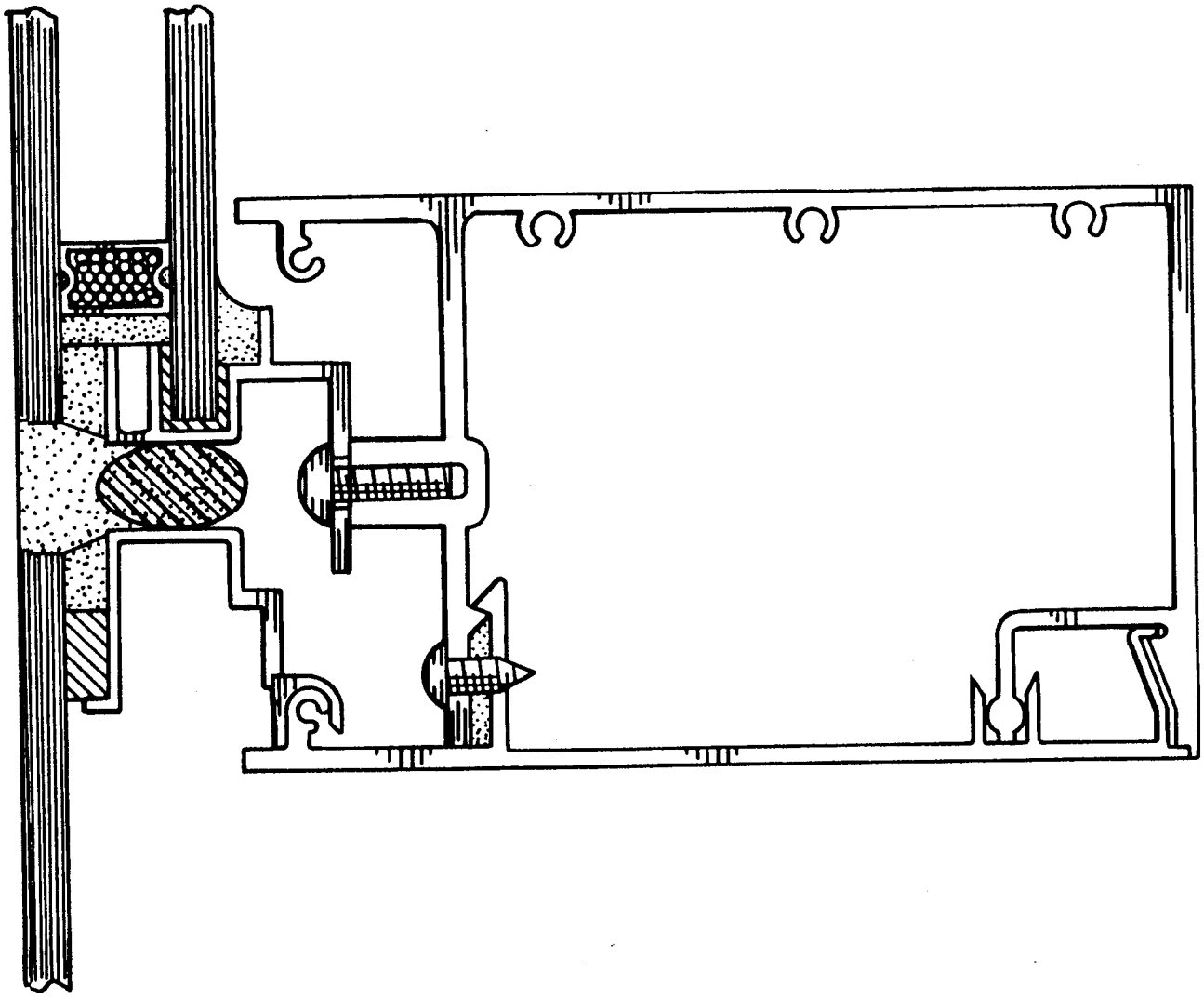
FIG. 7 is a section view through a portion of the building frame and connected window assemblies, one of which is a dual-pane assembly of the sort depicted in FIG. 2, and the other of which is a single-pane assembly of the sort depicted in FIG. 6, showing how the transition can be made from dual-pane to single-pane window assembly installations.

In many buildings, spandrel sections are, for each floor, placed immediately underneath vision sections of the window array. It is therefore desirable to make it as convenient as possible to have a single-pane window assembly hung next to a dual-pane window assembly. This objective can be accomplished by providing a hybrid arrangement which combines the features of FIGS. 2 and 6 side by side (in either a vertical or horizontal sense). Such hybrid arrangement is illustrated in FIG. 7. In FIG. 7, the left hand window assembly and associated extrusion are identical to those illustrated in FIG. 2, while the right hand window assembly and extrusion are identical to those shown in FIG. 6.

It is apparent that the arrangements depicted in FIGS. 6 and 7, like those of the earlier Figures, could be used for either vertical or horizontal installations, or both.

Other variants in what has been described are conceivable. For example, although the quick-fit designs described show the cooperating element for receiving the quick-fit element on the extrusion as being integral with the grid frame along one side edge thereof, it is possible to imagine alternative designs in which the cooperating element is located quite differently—possibly, for example, as a terminating male or female lug at the free end of flange 75 as seen in FIG. 2. Such imagined structure is considered inferior to what has been specifically described, since fastener 77 would in the imagined case become responsible for retaining two adjacent window panels in place, instead of just one. Nevertheless, such imagined structure may have other desired advantages, such as elimination of the necessity to configure the side of the mullion specially to receive a mating quick-fit element on one of the extrusions.

Further modifications and variations in the design of such window assemblies can readily be made by those skilled in the art without departing from the principles of the present invention, which is not to be limited by the specific embodiments illustrated but whose scope is as defined in the appended claims.

What is claimed is:

1. A pre-fabricated insulated window assembly for flush mounting to the grid frame or mullion of a building, said assembly comprising:

(a) an inboard glass lite;

(b) an outboard glass lite;

(c) separator means disposed around the inner periphery of said lites for maintaining parallel separation of said lites;

(d) sealing means disposed around said inner periphery for maintaining an airtight seal around said periphery;

(e) a peripheral gap formed between said lites by insetting said separator means and said sealing means from the edges of at least two opposed sides of said lites;

(f) first and second retaining means provided in said gap on at least said two opposed sides respectively for assisting in retaining said lites in spaced relation to one another and for attaching said assembly to said grid frame, each of said retaining means further comprising:

(i) a channel for mating with and tightly gripping one edge of said inboard lite;

(ii) a first bonding surface protruding into said gap, generally parallel to and spaced from the inner plane surface of said outboard lite to define a first recess for receiving bonding material; and, (iii) engagement means projecting inwardly relative to the inner surface of said inboard lite for engaging said grid frame;

said engagement means for said first retaining means further comprising a quick-fit positioning and retaining element mating with a complementary element on or fixed to said grid frame for quick, initial, positive positioning of one side of said assembly relative to said grid frame and, said engagement means for said second retaining means further comprising means for retaining in place a series of fasteners mating with complementary fastening means in or cooperating with said grid frame for subsequently fixing said second retaining means in place on said grid frame.

2. A window assembly as defined in claim 1, wherein each of said retaining means are formed as an integral extrusion approximately coextensive with the length of said edges on which said retaining means are respectively disposed, but terminating short of the corners of said lites so as to facilitate quick positioning of said assembly relative to said grid frame.

3. A window assembly as defined in claim 2, wherein said retaining means further comprises a second bonding surface protruding into said gap, generally parallel to and spaced from the inner plane surface of said inboard lite to define a second recess for receiving bonding material.

4. A window assembly as defined in claim 3, wherein said quick-fit positioning and retaining element comprises a female receptacle and said complementary element comprises a male element for mating engagement within said receptacle.

5. A window assembly as defined in claim 3, wherein said engagement means for said second retaining means comprises means for receiving a series of spaced bolts or screws for attachment to said frame.

6. A window assembly as defined in claim 3, wherein said assembly is of generally rectangular configuration and both of said two opposed sides thereof are provided with said first and second retaining means.

7. For use in the manufacture of a window assembly as defined in claim 3, an extrusion for forming said first retaining means.

8. For use in the manufacture of a window assembly as defined in claim 3, an extrusion for forming said second retaining means.

9. A window assembly as defined in claim 3, wherein said quick-fit positioning and retaining element comprises a male lug and said complementary element comprises a female element for mating engagement within said lug.

10. A window assembly as defined in claim 3, further comprising for each of said retaining means, a flexible pad or membrane interposed between at least said channel and said one edge of said inboard lite to provide a snug but resilient fit for said inboard lite in said channel.

11. A window assembly as defined in claim 10, wherein said retaining means is stepped inwardly of said inner surface of said inboard lite to define with said inner surface of said inboard lite said second recess for receiving bonding material.

12. A window assembly as defined in claim 3, wherein each said retaining means further comprises a flanged portion spaced outwardly from an outer surface of said channel, the outermost surface of said flanged portion constituting said first bonding surface and defining, with the opposed inner surface of said outboard lite, said first recess for receiving bonding material.

13. A window assembly as defined in claim 12, wherein each said extrusion is made of aluminum or an aluminum alloy.

14. A window assembly as defined in claim 12, wherein the bonding material is a chemical bonding agent.

15. A window assembly as defined in claim 12, wherein the bonding material is silicone.

16. A pre-fabricated insulated window assembly for flush mounting a lite of glass to a frame, wherein at least said two opposed sides of said assembly are provided with first and second retaining means respectively for assisting in retaining said lite in spaced relation to said frame and for attaching said lite within said assembly, each of said retaining means comprising:

(i) a first bonding surface generally parallel to and spaced from the inner plane surface of said lite to define a first recess for receiving bonding material; and (ii) engagement means projecting inwardly relative to said inner surface of said lite for engaging said frame;

said engagement means for said first retaining means further comprising a quick-fit positioning and retaining element mating with a complementary element on or fixed to said frame for quick positive positioning of one side of said assembly relative to said frame, and said engagement means for said second retaining means further comprising means for retaining in place a series of fasteners mating with complementary fastening means in or cooperating with said frame for fixing said second retaining means in place on said frame.

17. A window assembly as defined in claim 16, wherein each of said retaining means are formed as an integral extrusion approximately coextensive with the length of said edges on which said retaining means are respectively disposed, but terminating short of the corners of said lites so as to facilitate quick positioning of said assembly on said frame.

18. A window assembly as defined in claim 17, wherein said quick-fit positioning and retaining element comprises a female receptacle and said complementary element comprises a male element for mating engagement within said receptacle.

19. A window assembly as defined in claim 17, wherein said quick-fit positioning and retaining element comprises a male lug and said complementary element comprises a female element for mating engagement within said lug.

20. A window assembly as defined in claim 17, wherein said engagement means for said second retaining means comprises means for receiving a series of bolts or screws for attachment to said frame.

21. A window assembly as defined in claim 17, wherein said assembly is of generally rectangular configuration and both of said two opposed sides thereof are provided with said first and second retaining means.

* * * * *